United States Patent [19]

Katou et al.

[11] 4,304,179

[45] Dec. 8, 1981

[54] MARKING METHOD AND DEVICE

[75] Inventors: Hisashi Katou; Naoki Sakai; Hiromi Yazawa; Akio Matsunami; Tsutomu Yamazaki, all of Odawara, Japan

[73] Assignee: Fuji Photo Film Co., Ltd., Minami-ashigara, Japan

[21] Appl. No.: 100,801

[22] Filed: Dec. 6, 1979

[30] Foreign Application Priority Data

Dec. 15, 1978 [JP] Japan ..... 53/156173

[51] Int. Cl.[3] ..... B41C 1/06; B05B 5/02

[52] U.S. Cl. ..... 101/34; 101/426; 101/217; 101/DIG. 13; 101/35; 118/622; 355/3 TR

[58] Field of Search ..... 101/1 R, 426, DIG. 13, 101/33-35, 38 R, 212, 217; 355/3 DR, 3 TE, 3 TR, 9, 10; 118/620, 622, 214, 215; 430/31, 33, 35, 48, 49, 97-98, 101, 117, 118

[56] References Cited

U.S. PATENT DOCUMENTS

| | | | |
|---|---|---|---|
| 3,063,859 | 11/1962 | Heckscher | 430/48 |
| 3,368,525 | 2/1968 | Sacre | 118/622 X |
| 3,814,616 | 6/1974 | Kondo et al. | 118/622 X |
| 3,850,660 | 11/1974 | Inamura et al. | 118/622 X |
| 4,040,732 | 8/1977 | Hummel | 355/3 DR |
| 4,068,942 | 1/1978 | Penwell | 355/3 DR X |
| 4,115,114 | 9/1978 | Quang et al. | 430/35 |
| 4,158,071 | 6/1979 | Jordan et al. | 118/622 X |
| 4,172,429 | 10/1979 | Gregorec et al. | 101/35 X |
| 4,187,774 | 2/1980 | Iwasa et al. | 355/3 TR X |
| 4,195,927 | 4/1980 | Fotland et al. | 355/3 TE |

FOREIGN PATENT DOCUMENTS

| | | | |
|---|---|---|---|
| 2738545 | 8/1977 | Fed. Rep. of Germany | 355/3 TR |

*Primary Examiner*—E. H. Eickholt
*Attorney, Agent, or Firm*—Sughrue, Mion, Zinn, Macpeak & Seas

[57] ABSTRACT

A marking method and marking device for providing an image upon a steel material or other hardened surface. A toner image is formed on the surface of the marking drum having an elastic surface. The drum is placed in abutment with the material to be marked under pressure while at least one of the drum material to be marked is moved along the surface of the other to thereby transfer the toner image onto the surface to be marked. Toner fixing liquid is subsequently dispensed over the transferred image. Apparatus for driving and supporting the marking drum is disclosed including a swinging support arm which may be extendible in some embodiments so as to make the device capable of marking many types of surfaces.

6 Claims, 3 Drawing Figures

MARKING METHOD AND DEVICE

BACKGROUND OF THE INVENTION

The invention relates to a marking method and device by which hard materials including even solid steel materials can be marked.

In general, manufactured steel products are marked with characters and symbols such as lot numbers, standards, company marks, weight, users' names, and shipping marks. These markings are typically applied directly to each of the manufactured steel items. The contents of the markings can be varied considerably, including several tens to several hundreds of characters. In the case of a large diameter pipe more than 400 mm in outside diameter, it is necessary to mark the inner wall and/or the outer wall of the pipe. Since the marking contents and the marking positions are specified by the customer, the marking must necessarily be carried out by the steel material manufacturer.

Heretofore, steel materials were marked in accordance with a variety of methods such as a method utilizing electrostatic printing, a printing method using rubber stamps, and a paint spraying method using stencils which are provided by cutting characters in thin plates or papers. However, these conventional methods are disadvantageous in that manual composition is necessary and wasted materials such as stencils are needed. In the case where the surface to be marked is curved, it is difficult to bring the stencil fully into contact with the curved surface as a result of which the quality of the marking is lowered. Furthermore, for electrostatic printing, since the electrostatic printing plate is flat, the quality of the resultant marking is poor. Especially for marking the inner wall of a steel pipe, a method has been employed in which a worker sprays paint with a stencil placed on the inner wall of the pipe. This is a great obstruction in the steel pipe manufacturing process making it difficult to automatically mark steel pipes. The reason for this is that typically a large number of characters or symbols must be marked on a steel pipe and the surface to be marked is curved.

Accordingly, an object of this invention is to eliminate the above-described difficulties and to provide a marking method by which the curved surfaces of steel materials or the inner walls of steel pipes can be marked as described and to provide a marking device for practicing the method.

SUMMARY OF THE INVENTION

These, as well as other objects of the invention, may be met by a marking method in putting the steps of forming a toner image on the surface of a marking drum having an elastic surface, placing the marking drum in abutment under pressure against the surface of a steel material to be marked and driving at least one of the marking drum and steel material along the surface of the other to transfer the toner image onto the surface of the steel material. Once the toner image has been transferred to the steel material, it may be fixed by dispensing a toner image fixing liquid thereupon. Still further, in accordance with the objects of the present invention, there may be provided a marking device including a marking drum having an elastic surface for holding a toner image, means for forming a toner image on a surface of the marking drum, means for moving the marking drum between an abutment position on the surface of the steel material to be marked and the toner image forming means, means for driving at least one of the marking drum and steel material along the surface of the other, and means which is moved together with the marking drum by the driving means to selectively dispense a toner fixing liquid. The marking drum preferably has a layer of elastic material and a surface layer thereupon which maintains tension upon the surface of the first layer. The moving means preferably includes an arm upon which the marking drum is rotatably coupled at one end with the other end thereof coupled to a travelling bed. In some embodiments, the arm may be extendible.

The marking method and the marking device according to this invention will be described with reference to the accompanying drawings.

DESCRIPTION OF THE PREFERRED EMBODIMENTS

Figure 1:
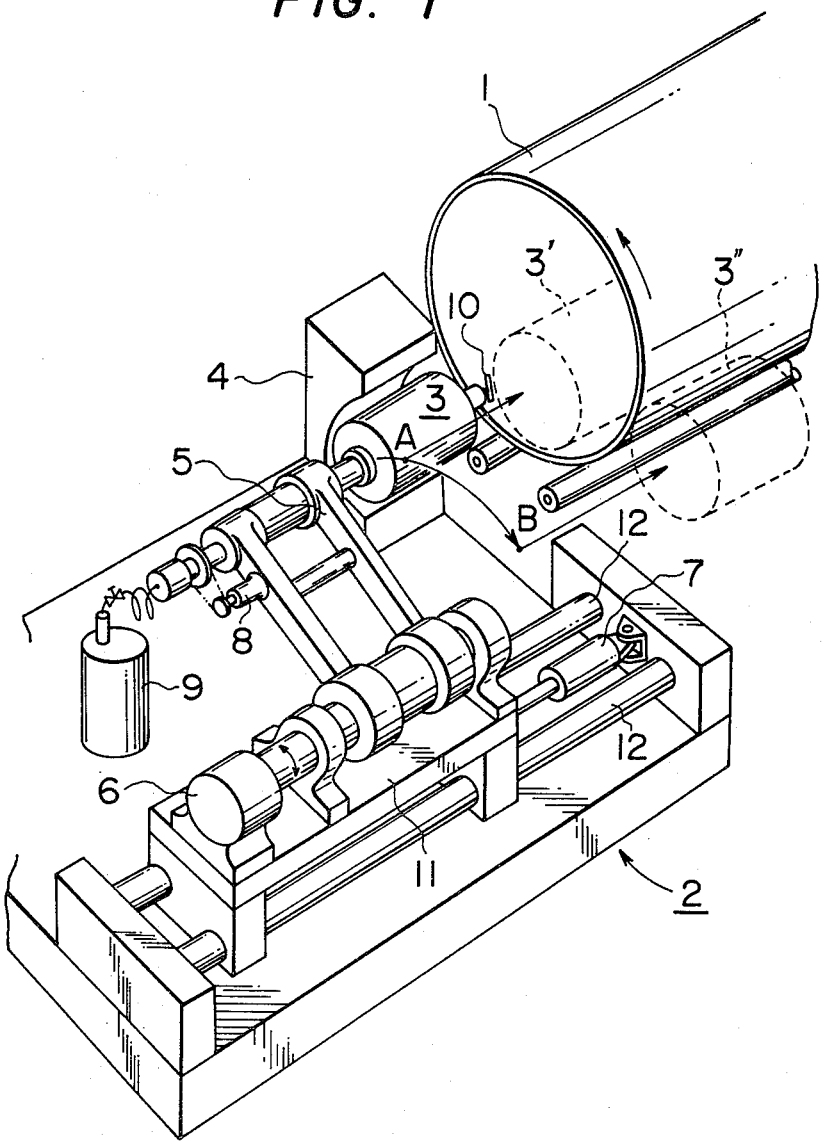
FIG. 1 is a perspective view illustrating a marking device for practicing a marking method according to this invention.

FIG. 1 is a perspective view showing an example of a device for practicing a marking method according to the present invention.

In FIG. 1, reference numeral 1 designates a cylindrical pipe on which characters or symbols are to be marked, and reference numeral 2 designates a marking device of the invention. The pipe 1 is supported by two parallel supporting rollers. Further in FIG. 1, reference numeral 3 designates a marking drum while reference numerals 3' and 3'' designate movement positions of the marking drum 3. The diameter of of the marking drum 3 is smaller than that of the pipe 1.

The marking drum 3 is rotatably mounted on the end portion of an arm 5 whose rotary shaft is coupled to a travelling bed 11. The marking drum 3 is rotated by an electric motor 8 mounted on the arm 5.

In FIG. 1, reference numeral 4 designates an image forming unit comprising an electrostatic latent image forming section, a developing section and a cleaning section to be described in detail below. The image forming unit 4 successively carries out cleaning the cylinder surface, forming an electrostatic latent image and developing the latent image with toner particles as the marking drum is rotated.

The arm 5 is swingably mounted to the travelling bed. After a toner image is formed on the surface of the marking drum 3, the arm 5 is swung from its position shown in FIG. 1 to the position A or B. The force for creating the swinging motion of the arm 5 is provided by a second electric motor 6.

When the arm 5 is positioned at either the position A or B, a cylinder 7 is operated to move the travelling bed 11 along a guide 12. As a result, when the arm 5 is at the position A, the marking drum is inserted into the pipe 1, and when the arm 5 is at the position B, the marking drum is moved to a position close to the outer wall of the pipe 1.

Thereafter, the arm 5 is swung further until the marking drum 3 abuts against the inner wall or the outer wall of the pipe 1 (as indicated by 3' or 3''). At this point, at least one of the two supporting rollers is rotated by a drive source (not shown) so that the pipe 1 is rotated around its central axis. If, in this case, the marking drum is allowed to freely rotate around its axis, then the marking drum is rotated through frictional force as the pipe 1 is rotated. As a result, the toner image on the marking drum 3 is transferred onto the inner wall or the outer wall of the pipe 1 by a phenomenon to be described below.

A fixing liquid spray nozzle 10 is provided on one end of the shaft of the marking drum 3 which is opposite to the end of the shaft where the arm 5 is provided. When the marking drum 3 is withdrawn from the pipe after the transfer of the toner image, the fixing liquid is sprayed to fix the toner image which has been transferred onto the surface of the pipe. In FIG. 1, reference numeral 9 designates a fixing liquid tank and fixing liquid supplying device which operates to supply the fixing liquid through the inside of the shaft of the marking drum 3 to the spray nozzle 10. Thus, characters or symbols can be marked on the inner surface or the outer surface of the pipe as desired.

Figure 2:
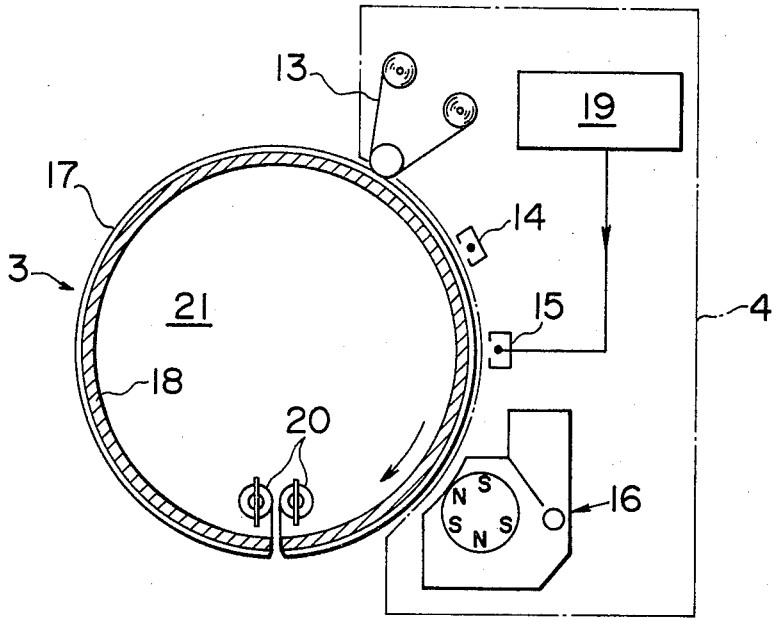
FIG. 2 is cross-sectional view showing a mechanism for forming a toner image on a marking drum.

FIG. 2 is a sectional view schematically illustrating the marking drum 3 and the image forming unit 4. The marking drum 3 includes a base drum 21, an elastic material 18 such as rubber or sponge wound on the drum 21, and a film-shaped electrostatic recording material 17 wound around the elastic material 18. Tension is provided to the film-shaped electrostatic recording member 17 by means of tightening member 20. The electrostatic recording material 17 is produced by rendering electrically conductive one surface of an otherwise electrically high insultative film of polyethylene terephthalate (PET), polyimido, polystyrene, or the like such as by metal vacuum evaporation or metal plating. The base thickness of the recording material 17 is of the order of 20 to 200$\mu$ depending on the latent image forming means and the developing means employed. The film 17 is wound around the elastic material layer 18 on the drum core 21 in such a manner that the electrically conductive surface thereof is on the inside for use as an opposition electrode in forming an electrostatic latent image.

The image forming unit 4 is provided with a cleaning paper 13 which is brought into contact with the surface of the marking drum 3 to remove the used toner therefrom to clean the surface of the electrostatic recording material 17. The image forming unit 4 is further provided with a corona charger 14 for electrically discharging or charging the surface of the electrostatic recording material.

In FIG. 2, reference numeral 15 designates an ion flow charger. The ion flow charger selectively causes corona ions to flow in accordance with a signal from switching unit 19 thereby forming an electrostatic latent image on the recording material 17. The electrostatic latent image is developed by a magnetic brush-type developing device 16.

The above-described arrangement of the image forming unit 4 is merely one example thereof. That is, it may employ other systems or devices as well. For instance, instead of the cleaning paper 13, a fur brush extensively employed in electrophotography may be used. Furthermore, instead of employing electrostatic latent image recording utilizing an ion flow, an electrostatic recording system using a needle-like discharge electrode as disclosed in U.S. Pat. Application Ser. No. 886,448, filed Mar. 14, 1978, now U.S. Pat. No. 4,192,232 issued Dec. 18, 1980, may be employed. In addition, instead of the developing system using a magnetic brush, a cascade system well-known in the electrophotographic art or a touchdown developing system as described in the specification of U.S. Pat. Application Ser. No. 886,449, filed Mar. 14, 1978, now pending as a continuation application Ser. No. 132,976 filed on Mar. 24, 1980, be employed. Accordingly, various modifications and alterations within the scope of the invention can be readily conceived combining such systems with an electrophotographic technique.

Figure 3:
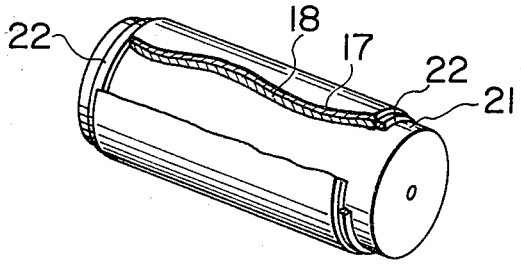
FIG. 3 is a perspective view with partially cut-away portions showing the marking drum of FIG. 2.

FIG. 3 is a perspective view with portions cut away showing the marking drum 3. In FIG. 3, reference numeral 21 designates the core of the marking drum 3, 18 the elastic material layer of rubber or sponge, 22 guide rings provided on the surface of the drum core 21 and adjacent to both ends of the elastic material layer 18, and 17 the electrostatic recording material.

The surface of the electrostatic recording material 17 is higher by 1–2 mm than the surface of the elastic material layer 18. However, when the marking drum abuts against a pipe to be marked, the elastic material layer is compressed as a result of which the guide rings 22 are brought into contact with the surface of the pipe. The material of the guide rings 22 is harder than that of the elastic material layer 18 so that further compression of the elastic material layer is prevented and the frictional force causes the marking drum to rotate with the rotation of the pipe.

The toner image on the surface of the marking drum is transferred onto the inner or outer wall of the pipe as the toner physically adheres to the inner or outer wall of the pipe as it is brought into contact therewith. The toner, being charged, is electrostatically attracted by charges induced in the pipe. Accordingly, in transferring the toner image, all that is necessary is for the marking drum to come into contact with the inner or outer wall of the pipe. That is, it is unnecessary for the marking drum to strongly press against the pipe. It has been verified by experiments that, when compared with a so-called "pressure transfer process" in which transferring is effected by pressure, the transferring efficiency of the system of the invention is high because the electrostatic attraction force acts between the toner and the pipe. A transferring efficiency of more than 70% can be readily obtained. In this connection, as the potential of the electrostatic latent image on the marking drum is decreased and charging the tone is increased, the transferring efficiency is increased.

In the above description, the pipe 1 is rotated to rotate the marking drum 3 which is in frictional contact with the pipe 1. However, the marking drum 3 may be rotated so as to move along the surface to be marked of the pipe 1. In the latter case, the arm 5 must be extendible so that the marking drum 3 can move along the surface to be marked. No particular control is necessary to extend the arm 5. For instance, all that is required is that a part of the arm 5 be engaged with the edge of the pipe so that it extends following the rotational movement of the marking drum.

The surface or the electrostatic recording material of the marking drum is in contact with the pipe. Therefore, if the marking drum is used many times the recording material may be scratched or it may deteriorate.

Accordingly, whenever the electrostatic recording material is used a predetermined number of times, it is advisable to replace it with a new one. As the electrostatic recording material is subject to being scratched as described above, it is accordingly essential to form an electrostatic latent image as remotely as possible in view of the stability of the device. In general, in an electrostatic recording system using a needle-like electrode, the distance between the electrode and the recording material is short, only about 20 to 100μ. On the other hand, in the ion flow method referred to in conjunction with the description of FIG. 2, the distance between the electrode and the recording material is more than 1 mm. Accordingly, employment of the ion flow method is especially effective.

In the case where the inner or outer surface of a steel material including a pipe to be marked is so uneven as to be beyond the range of elastic force of the marking drum or in the case where the surface potential of the electrostatic latent image is high, difficulties in that the toner image may not be transferred or the transferring efficiency may be decreased may be encountered. In such a case, it is considered effective to apply a transferring or bias voltage to the marking drum. According to experiments conducted by the inventors, application of a voltage of the order of 500 to 1,000 volts can increase the transferring efficiency and prevent irregular transfer due to irregular contact.

The provision of the elastic material layer on the marking drum eliminates the effects of an uneven inner or outer surface of a pipe to be marked thereby bringing the recording surface into sufficient contact with the inner or outer surface of the pipe. Furthermore, the elastic material layer is effective in absorbing contact unbalance at the two ends of the marking drum which may occur when the axes of the marking drum and the pipe are not in parallel with each other so that the marking drum is brought in uniform contact with the entire surface of the pipe.

A particularly advantageous feature of the case where the electrostatic recording system is employed to form a toner image resides in that marking with a great deal of information can be effected automatically on line with a simple mechanism as manual composition of the matter to be marked is unnecessary.

In the above description with reference to the accompanying drawings, an electrostatic latent image is formed on the marking drum and the image is developed with toner. However, a method is anticipated within the scope of the invention in which a toner image formed by an ordinary electrophotographic means is transferred onto the marking drum and is then transferred onto a steel material again.

In the above-described example, a cylindrical pipe is marked. However, an object to be marked according to the invention may also be a structure having a flat surface. For instance, the inner surface of a steel material having an L-shaped or U-shaped section can be marked according to the invention. In this case, it is necessary to move the steel material perpendicularly to the rotary shaft of the marking drum without rotating the steel material.

It goes without saying that the radius of the marking drum must be smaller than the radius of curvature of a steel material surface to be marked. However, according to the invention, if the diameter of the marking drum is small in comparison with the section between internal chambers of a steel material, then even an inner curved surface of the steel material can be marked irrespective of the diameter thereof.

What is claimed is:

1. A marking method comprising the steps of: forming at a first station a toner image on the surface of a rotatable marking drum having an elastic surface, moving said marking drum to a second station where it is in abutment under pressure against a surface of a steel material to be marked, and driving at least one of said marking drum and steel material along the surface of the other to rotate said marking drum and transfer said toner image onto the surface of said steel material.

2. The marking method of claim 1, further comprising the step of dispensing toner image fixing liquid upon at least portions of a surface of said steel material upon which toner is transferred.

3. A marking device comprising: a marking drum having an elastic surface for holding a toner image, means for forming a toner image on the surface of said marking drum, means for moving said marking drum between an abutment position on the surface of a steel material to be marked and said toner image forming means, means for driving at least one of said marking drum and steel material along the surface of the other, and means moved together with said marking drum by said driving means to selectively dispense a toner image fixing liquid.

4. A marking device as claimed in claim 3 wherein said marking drum comprises a first layer of elastic material and a surface layer provided to maintain tension upon the surface of said first layer.

5. The marking device as claimed in claim 3 wherein said moving means comprises an arm having one end thereof rotatably coupled to said marking drum and the other end thereof coupled to a travelling bed.

6. The marking device as claimed in claim 5 wherein said arm is extendible.

* * * * *